US005133113A

United States Patent [19]

Mueller et al.

[11] Patent Number: 5,133,113

[45] Date of Patent: Jul. 28, 1992

[54] CLAMP FOR AN ELONGATE MEMBER

[75] Inventors: Michael M. Mueller, Portland; Jeffrey P. Kosmoski, Tigard, both of Oreg.

[73] Assignee: Photon Kinetics, Inc., Beaverton, Oreg.

[21] Appl. No.: 682,929

[22] Filed: Apr. 9, 1991

[51] Int. Cl.[5] ..... A44B 21/00; B25B 1/20

[52] U.S. Cl. ..... 24/517; 24/504; 24/520; 269/128

[58] Field of Search ..... 24/517, 520, 504, 505, 24/329, 330, 331, 332; 403/373; 269/127, 128

[56] References Cited

U.S. PATENT DOCUMENTS

| | | | |
|---|---|---|---|
| 341,365 | 5/1886 | Wilson | 24/517 |
| 381,265 | 4/1888 | Martens | 24/517 |
| 1,083,385 | 1/1914 | Burgess | 24/517 |
| 1,150,962 | 8/1915 | Pederson | 269/128 |
| 1,310,519 | 7/1919 | Bair | 24/517 |
| 1,951,064 | 3/1934 | Richards et al. | 24/504 |
| 2,873,995 | 2/1959 | Turner | 24/517 |
| 3,503,244 | 3/1970 | Joslin | 24/517 |
| 3,837,633 | 9/1974 | Paulsen | 24/517 |
| 4,074,897 | 2/1978 | Behn | 269/128 |

*Primary Examiner*—Victor N. Sakran
*Attorney, Agent, or Firm*—Dellett, Smith-Hill and Bedell

[57] ABSTRACT

A clamp for gripping an elongate member comprises a mounting block having locating structures defining a desired position for the elongate member. Primary and secondary clamping yokes are each movable relative to the mounting block between a closed position, in which the clamping yoke engages an elongate member in the desired position, and an open position. A latch retains the primary clamping yoke in the closed position, and a force-transfer arm is effective between the primary clamping yoke and the secondary clamping yoke for retaining the secondary clamping yoke in its closed position when the primary clamping yoke is in its closed position.

18 Claims, 2 Drawing Sheets

CLAMP FOR AN ELONGATE MEMBER

BACKGROUND OF THE INVENTION

This invention relates to a clamp for an elongate member.

An optical fiber comprises a core and a cladding, both made of glass. The diameter of an optical fiber is typically about 125 microns.

Optical fibers are rather brittle and cannot withstand considerable handling. In order to protect the fiber, it is usual to encase the fiber in a buffer layer of synthetic polymer material. The nature of the polymer material and the thickness of the buffer layer depend upon the use to which the fiber will be put. Thus, when the fiber is to be wrapped with other fibers in a cable, a buffer layer that is thin and hard may be adequate, whereas a thicker yet softer cladding may be appropriate when the fiber is to be used as part of a communication network in an office building and will receive fairly rough handling during installation.

Various tests are performed on optical fibers in order to ensure that they will meet specifications. Some of the tests are carried out using a test and measurement instrument that includes a camera. A length segment of the fiber is held in the test and measurement instrument by a clamp that grips the buffer layer at a location close to an end face of the fiber, and the clamp is mounted on the stage of the test and measurement instrument so that the length segment of fiber lies on the optical axis of the camera and the end face is presented toward the camera.

Known optical fiber clamps operate satisfactorily in a test and measurement instrument when the buffer layer is quite thin and does not undergo significant flow during the time taken to conduct a test. However, it is not satisfactory to clamp a fiber having a thick buffer of soft material in this fashion, because the buffer undergoes progressive deformation in the clamp and consequently the end face of the fiber moves relative to the optical axis of the measurement instrument.

SUMMARY OF THE INVENTION

In accordance with a first aspect of the present invention, a clamp for gripping an elongate member comprises a base member having locating means defining a desired position for the elongate member, a primary clamping member movable relative to the base member between a closed position, in which it engages an elongate member in the desired position, and an open position, a secondary clamping member movable relative to the base member between a closed position, in which it engages an elongate member in the desired position, and an open position, means for retaining the primary clamping member in the closed position, and force-transfer means effective between the primary clamping member and the secondary clamping member for retaining the secondary clamping member in its closed position when the primary clamping member is in its closed position.

In accordance with a second aspect of the invention, a clamp for gripping an elongate member comprises a base member having a generally flat bottom surface, locating means defining a desired position for the elongate member, a clamping member movable relative to the base member between a closed position, in which it engages an elongate member in the desired position, and an open position, and latch means for retaining the clamping member in the closed position. The latch means comprises a hook structure that is engageable with the base member and is movable relative to the clamping member, when the clamping member is in its closed position, between a first position in which the hook structure engages the base member and a second position in which the hook structure is disengaged from the base member, and spring means exerting a force directed substantially perpendicular to the bottom surface of the base member when the clamping member is in the closed position, said force urging the hook structure toward its first position.

BRIEF DESCRIPTION OF THE DRAWINGS

For a better understanding of the invention, and to show how the same may be carried into effect, reference will now be made, by way of example, to the accompanying drawings in which.

DETAILED DESCRIPTION

Figure 1:
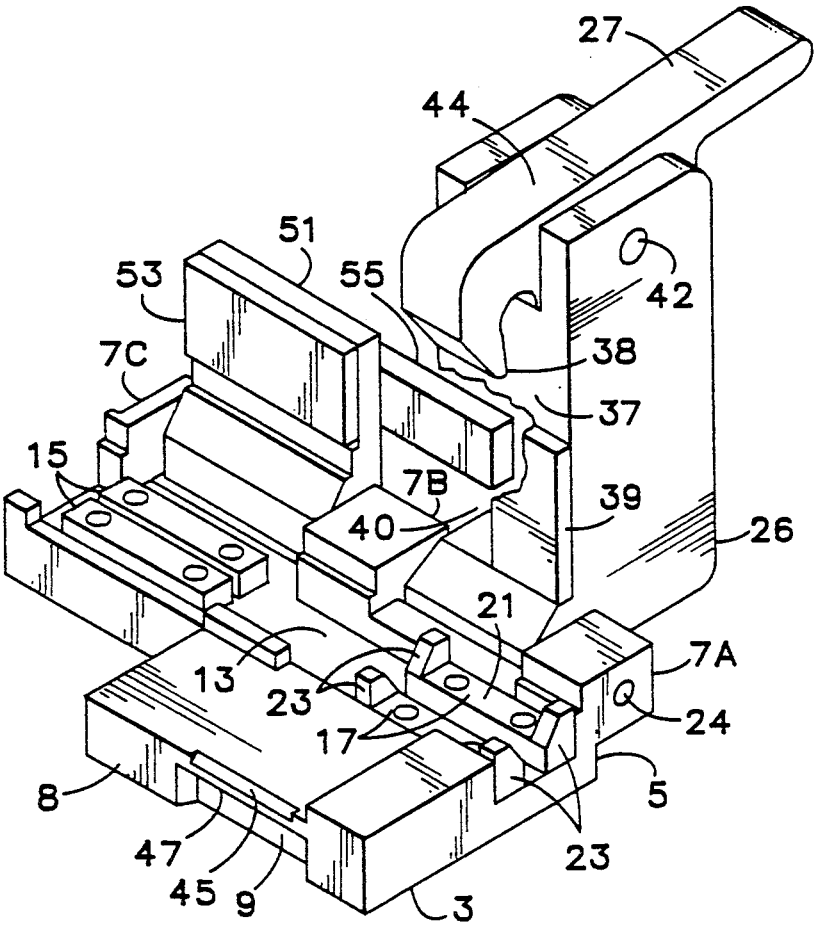
FIG. 1 is a perspective view of a two-stage clamp when in the open position.
Figure 5:
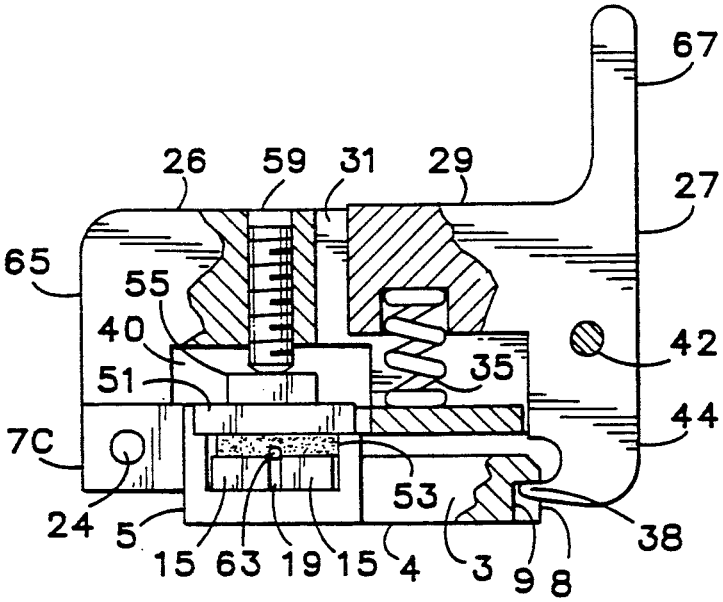
FIG. 5 is a partially broken away end view of the clamp taken on the line V—V of FIG. 4.

Referring to FIGS. 1 and 5, the illustrated clamp comprises a mounting block 3 having a flat bottom surface 4, a rear edge 5 from which knuckles 7A–7C project, and a forward edge 8 formed with a recess 9.

The mounting block 3 is formed with a channel that extends adjacent the knuckles 7A–7C, parallel to the rear edge 5 of the mounting block. Two pairs of locating members 15 and 17 are mounted in channel 13 at opposite ends thereof by means of screws (not shown). The locating members 15 are generally flat and are disposed alongside each other at a spacing no greater than about 10 microns. A narrow gap 19 necessarily exists between locating members 15.

Locating members 17 each have a base portion 1 that extends longitudinally of channel 13 and two ears 23 that project upwardly from base portion 1 at opposite respective ends thereof, so that there are two pairs of ears 23 spaced apart along channel 13. Each pair of ears 23 forms a V-shaped notch.

Figure 2:
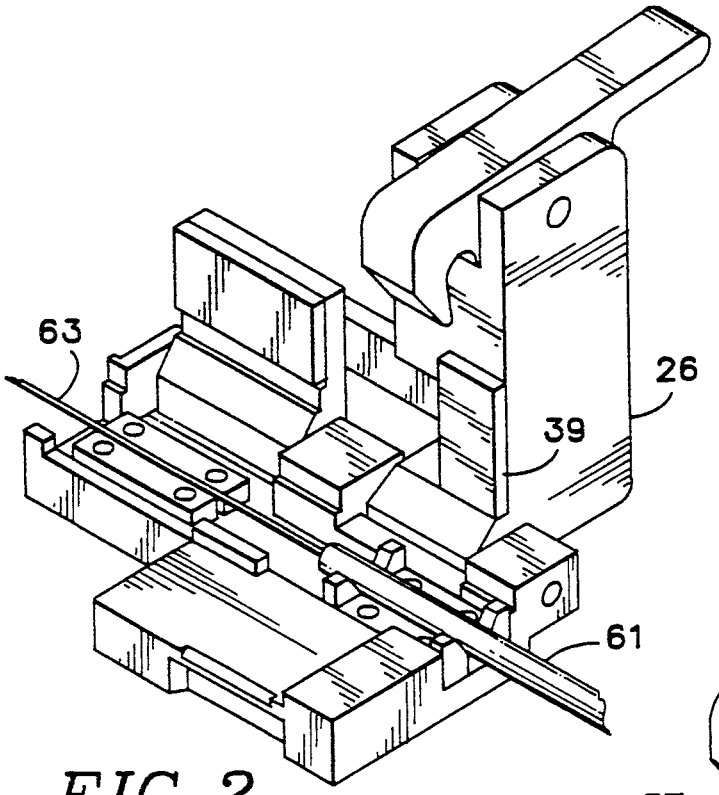
FIG. 2 is a view similar to FIG. 1 with an optical fiber received in the clamp.
Figure 3:
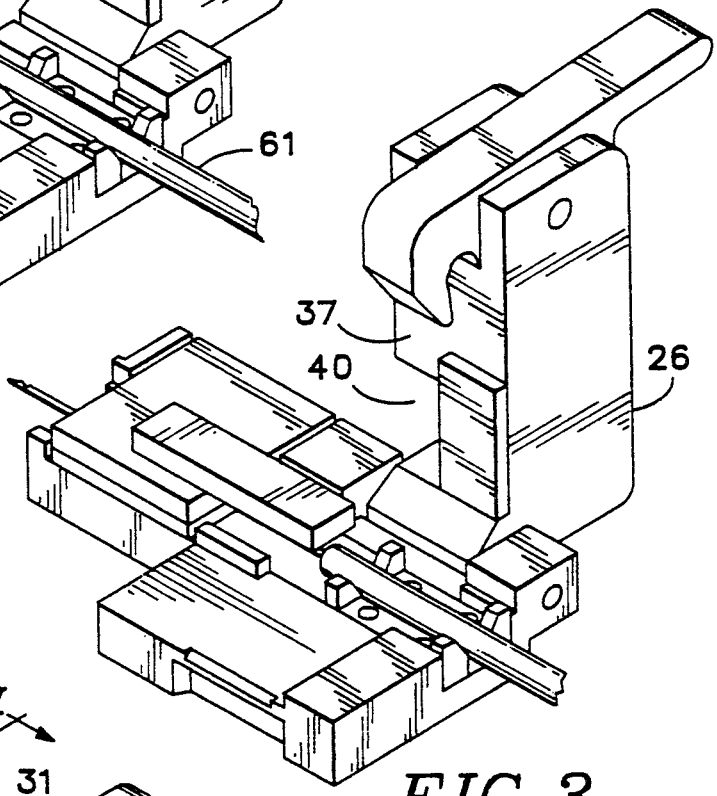
FIG. 3 is a perspective view of the clamp when in a partially closed position.

A hinge pin 24 extends through knuckles 7A–7C, parallel to the rear edge 5 of the mounting block. A latching yoke 26 is mounted on the hinge pin between knuckles 7A and 7B and is pivotable relative to the mounting block about the longitudinal axis of the hinge pin between a closed position (FIGS. 4 and 5) and an open position (FIGS. 1–3). Latching yoke 26 has a bottom surface 37 to which a pad 39 of resiliently compressible material is attached. Latching yoke 26 is formed with a recess 40 adjacent pad 39, and a set screw 59 projects into recess 40.

A latch 27 is mounted to latching yoke 26 by means of a pivot pin 42 that allows pivotal movement of the latch relative to the latching yoke about an axis parallel to the longitudinal axis of pin 24. Latch 27 is generally L-shaped, and a first limb 29 of the L extends in a recess 31 formed in latching yoke 26. A compression spring 35 that is effective between limb 29 and the base of recess 31 biases the latch in the clockwise direction seen in FIG. 5.

Latch 29 has a second limb 44 that extends perpendicular to limb 29 and includes a hook formation 38 that is able to enter the recess 9 at the forward edge 8 of the mounting block when the latching yoke is in its closed position. When the latch is pivoted from the open position toward the closed position, the hook formation 38 engages a cam surface 45 above recess 9. By application of downward force to yoke 26, a camming force is generated urging latch 27 in the clockwise direction viewed from the right of FIG. 1. If the downward force is applied to yoke 26 through the limb 29 of latch 27 and spring 35, the downward force causes latch 27 to rotate relative to yoke 26 in the counterclockwise direction seen in FIG. 5 and the hook formation is urged over the threshold 47 to enter recess 9. Therefore, when the clamp is placed on a horizontal surface, the latching yoke can be latched to the mounting block by application of downward force without creating any force component that would tend to shift the clamp horizontally.

When the latching yoke is latched to mounting block 3, the resilient pad 39 spans channel 13 between the two pairs of ears 23.

An auxiliary yoke 51 is mounted on mounting block 3 between knuckles 7B and 7C so as to be pivotable relative to block 3 about the longitudinal axis of pivot pin 24. The auxiliary latch 51 spans channel 13 over locating members 15, and a resilient pad 53 is attached to auxiliary yoke 51. A force-transmission arm 55 projects from the auxiliary yoke into the recess 40 of latching yoke 26. When the latching yoke 26 is pivoted towards its closed position, set screw 59 engages the force-transmission arm 55 of auxiliary yoke 51, and consequently yoke 51 is retained in its closed position when yoke 26 is in its closed position.

Figure 4:
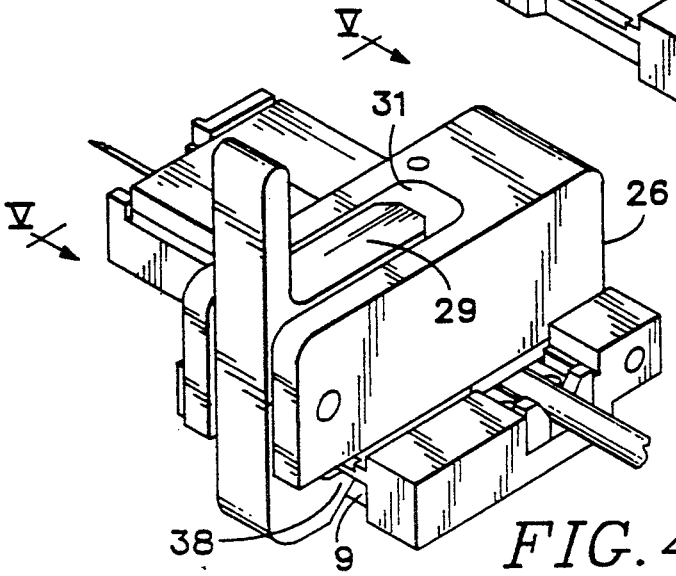
FIG. 4 is a perspective view of the clamp when in the fully closed position.

In use of the clamp shown in the drawings, the buffer layer is stripped from a portion of a length segment of optical fiber to expose the cladding. The optical fiber is placed in the clamp with the unstripped portion 61 in the notches defined by the two pairs of ears 23 and the stripped portion 63 seated along the gap 19 between locating members 15, as shown in FIG. 2. The auxiliary yoke is pivoted to its closed position, as shown in FIG. 3 and the latching yoke is then pivoted to the position in which the hook formation 38 engages camming surface 45. Pressure is then applied to the limb 29 of the latch 27, and latching yoke 26 is latched to mounting block 3 by engagement of hook formation 38 in recess 9, as shown in FIGS. 4 and 5. The end of the fiber may then be presented to a cleaver, or if the end has previously been cleaved and the clamp is mounted on the stage of a measurement instrument, measurements may be carried out on the fiber. The latching yoke serves as a strain relief mechanism that grips the fiber firmly by way of the buffer layer, while the auxiliary yoke holds the core and cladding against movement when the buffer layer undergoes deformation. The spacing between the two pairs of locating members 15 and 17 ensures that any movement of the fiber that takes place due to deformation of the buffer layer will not cause significant movement of the end face of the fiber or apply strain to the fiber.

The clamp is released by rotating latch 27 relative to yoke 26 in the counterclockwise direction seen in FIG. 5, for example by gripping the rear surface 65 of the latching yoke 26 and the upright arm 67 attached to the latch between thumb and forefinger and applying compression force, thereby pivoting latch 27 in the counterclockwise direction seen in FIG. 5 and withdrawing the hook formation from the recess 8.

Adjustment of the set screw 59 allows the force that is applied to pad 53 when latching clamp 26 is in its closed position to be varied selectively.

It will be appreciated that the invention is not restricted to the particular embodiment that has been described, and that variations may be made therein without departing from the scope of the invention as defined in the appended claims and equivalents thereof.

We claim:

1. A clamp for gripping an elongate member, the clamp comprising:

a base member having locating means defining a desired position for the elongate member, said locating means defining an axis along which the elongate member extends when in the desired position, a primary clamping member movable relative to the base member between a closed position, in which it engages an elongate member in the desired position, and an open position, a secondary clamping member movable relative to the base member between a closed position, in which it engages an elongate member in the desired position, and an open position, the secondary clamping member being freely movable between its closed position and its open position when the primary clamping member is in its open position and being spaced apart along said axis from the primary clamping member, means for retaining the primary clamping member in the closed position, and force-transfer means effective between the primary clamping member and the secondary clamping member for retaining the secondary clamping member in its closed position when the primary clamping member is in its closed position.

2. A clamp according to claim 1, wherein the primary clamping member is pivotable relative to the base member, and the means for retaining the primary clamping member in the closed position comprise a latch member mounted to the primary clamping member and engageable with the base member.

3. A clamp according to claim 2, wherein the base member has a generally planar bottom surface, and the latch member includes a hook formation for engaging a recess in the base member, the latch member being pivotable relative to the primary clamping member about an axis that is parallel to the bottom surface of the base member.

4. A clamp according to claim 3, wherein the latch member includes an actuation portion that extends generally parallel to the bottom surface of the base member when the primary clamping member is in its closed position, and the clamp further comprises a spring that engages the actuation portion and urges the latch member to pivot relative to the primary clamping member toward the position in which the hook formation engages the recess in the base member.

5. A clamp according to claim 1, wherein the primary clamping member and the secondary clamping member are each pivotable relative to the base member between the closed position and the open position, and wherein the force-transfer means comprise an arm that projects from the secondary clamping member into the path of movement of the primary clamping member from its open position toward its closed position.

6. A clamp according to claim 1, wherein the locating means comprise a first locating structure defining at least one notch and a second locating structure defining a narrow slot, and wherein the primary clamping member engages the first locating structure when in the closed position and the secondary clamping member engages the second locating structure when in the closed position.

7. A clamp according to claim 1, wherein the primary clamping member and secondary clamping member are pivotable about a common axis that is substantially parallel to the axis defined by said locating means.

8. A clamp for gripping an elongate member, the clamp comprising:

a base member having a generally flat bottom surface, locating means defining a desired position for the elongate member, a clamping member movable relative to the base member between a closed position, in which it engages an elongate member in the desired position, and an open position, and latch means for retaining the clamping member in the closed position, the latch means comprising a hook structure that is engageable with the base member and is movable relative to the clamping member, when the clamping member is in its closed position, between a first position in which the hook structure engages the base member and a second position in which the hook structure is disengaged from the base member, and spring means exerting a force directed substantially perpendicular to the bottom surface of the base member when the clamping member is in the closed position, said force urging the hook structure toward its first position.

9. A clamp according to claim 8, wherein the base member has first and second opposite edges, the clamping member is pivotable relative to the base member about an axis adjacent the first edge of the base member, and the base member is formed with a recess at its second edge for receiving the hook structure when the clamping member is in its closed position.

10. A clamp according to claim 9, wherein the latch means comprise a substantially L-shaped member having two limbs extending at substantially 90° from each other, the hook structure being at one end of one limb and the spring means exerting a force against the other limb.

11. A clamp according to claim 10, wherein the latch member is pivotable relative to the clamping member about an axis that is substantially perpendicular to both limbs of the latch member and extends through the latch member in the region at which the first and second limbs meet.

12. A clamp according to claim 11, wherein the clamping member is pivotable relative to the base member about an axis that is substantially parallel to the axis of pivotal movement of the latch member.

13. A clamp according to claim 8, wherein the clamping member is pivotable relative to the base member and the hook structure is pivotable relative to the clamping member about an axis that is substantially parallel to the axis of pivotal movement of the clamping member.

14. A clamp according to claim 13, wherein the clamping member comprises an abutment portion that is substantially parallel to the bottom surface of the base member when the clamping member is in tis closed position, the hook structure includes an arm that extends substantially parallel to said abutment portion and is spaced therefrom, and the spring means comprise a compression spring effective between said abutment portion and the arm of the hook structure, whereby application of force to the arm urging the arm toward the base member both urges the clamping member toward its closed position and urges the hooks structure toward it second position, allowing the clamping member to attain its closed position.

15. A clamp for gripping an elongate member, the clamp comprising:

a base member having locating means defining a desired position for the elongate member, the base member having a generally planar bottom surface, a primary clamping member pivotable relative to the base member between a closed position, in which it engages an elongate member in the desired position, and an open position, a secondary clamping member movable relative to the base member between a closed position, in which it engages an elongate member in the desired position, and an open position, a latch member pivotable relative to the primary clamping member about an axis that is parallel to the bottom surface of the base member, the latch member including a hook formation engageable with the base member for retaining the primary clamping member in the closed position, and an actuation portion that extends generally parallel to the bottom surface of the base member when the primary clamping member is in its closed position, and a spring that engages the actuation portion and urges the latch member to pivot relative to the primary clamping member toward the position in which the hook formation engages the recess in the base member.

16. A clamp for gripping an elongate member, the clamp comprising:

a base member having locating means defining a desired position for the elongate member, a primary clamping member pivotable relative to the base member between a closed position, in which it engages an elongate member in the desired position, and an open position, a secondary clamping member pivotable relative to the base member between a closed position, in which it engages an elongate member in the desired position, and an open position, means for retaining the primary clamping member in the closed position, and an arm that projects from the secondary clamping member into the path of movement of the primary clamping member from its open position toward its closed position for retaining the secondary clamping member in its closed position when the primary clamping member is in its closed position.

17. A clamp according to claim 16, wherein the primary clamping member is pivotable relative to the base member, and the means for retaining the primary clamping member in the closed position comprise a latch member mounted to the primary clamping member and engageable with the base member.

18. A clamp according to claim 17, wherein the base member has a generally planar bottom surface, and the latch member includes a hook formation for engaging a recess in the base member, the latch member being pivotable relative to the primary clamping member about an axis that is parallel to the bottom surface of the base member.

* * * * *

UNITED STATES PATENT AND TRADEMARK OFFICE

CERTIFICATE OF CORRECTION

PATENT NO. : 5,133,113

DATED : July 28, 1992

INVENTOR(S) : Michael M. Mueller; Jeffrey P. Kosmoski

It is certified that error appears in the above-identified patent and that said Letters Patent is hereby corrected as shown below:

Column 2, line 45, "portion 1" should read --portion 21--.

Column 2, line 47, "portion 1" should read --portion 21--.

Column 5, line 66, "tis closed" should read --its closed--.

Signed and Sealed this

Thirty-first Day of August, 1993

Bruce Lehman

*Attest:*

BRUCE LEHMAN

*Attesting Officer*

*Commissioner of Patents and Trademarks*